United States Patent [19]

Snow

[11] Patent Number: 4,834,644

[45] Date of Patent: May 30, 1989

[54] PREMIX OVEN PULSING CONTROL SYSTEM

[75] Inventor: Bill D. Snow, Forth Worth, Tex.

[73] Assignee: Snow Corporation, Fort Worth, Tex.

[21] Appl. No.: 17,636

[22] Filed: Feb. 24, 1987

[51] Int. Cl.[4] ..... F23M 5/00; F27D 7/00

[52] U.S. Cl. ..... 431/1; 431/278; 431/12; 431/18; 431/73; 431/86; 432/18; 432/24; 432/25

[58] Field of Search ..... 431/1, 6, 12, 18, 62, 431/63, 278, 73, 86; 432/18, 24, 25

[56] References Cited

U.S. PATENT DOCUMENTS

| | | | |
|---|---|---|---|
| 923,474 | 6/1909 | Willson | 431/1 X |
| 2,482,565 | 9/1949 | Tramontini | 431/62 X |
| 2,730,169 | 1/1956 | Deubel | 431/86 |
| 2,869,624 | 1/1959 | Walper et al. | 431/1 X |
| 3,584,849 | 6/1971 | Cremer | 432/25 X |
| 3,845,582 | 11/1974 | Capy | 431/1 |
| 3,877,867 | 4/1975 | Tsuchiya et al. | 432/45 |
| 4,069,008 | 1/1978 | Bloom | 432/59 X |
| 4,309,168 | 1/1982 | Prill et al. | 431/12 X |
| 4,376,626 | 3/1983 | Rossi et al. | 431/86 X |
| 4,411,385 | 10/1983 | Liamkecisitz | 431/18 X |
| 4,425,930 | 1/1984 | Kruto | 431/62 X |
| 4,498,864 | 2/1985 | Roth et al. | 432/8 |
| 4,583,936 | 4/1986 | Krieger | 431/1 |
| 4,604,050 | 8/1986 | Henriksson | 431/7 X |

FOREIGN PATENT DOCUMENTS

| | | | |
|---|---|---|---|
| 1508595 | 9/1971 | Fed. Rep. of Germany | 432/25 |
| 1188451 | 10/1985 | U.S.S.R. | 431/1 |
| 2099130 | 12/1982 | United Kingdom | 431/18 |

*Primary Examiner*—Albert J. Makay

*Assistant Examiner*—Carl D. Price

*Attorney, Agent, or Firm*—Arthur F. Zobal

[57] ABSTRACT

A plurality of burners are provided for burning a combustible gas mixture. A conduit extends to each of the burners for supplying a combustible gas mixture thereto. A mixing device is coupled between the conduit and a source of air and a source of combustible gas for mixing combustible gas and air for flow to the conduit. An air valve is coupled between the source of air and the mixing device for controlling the flow of air to the mixing device. First and second gas valves are coupled between the source of combustible gas and the mixing device. A control circuit is provided which is adapted to be operated in a flame intensity cycle of high/low flame or in a burner on/off cycle. In the flame intensity cycle, flow of air through the air valve is cyclically increased and decreased and gas flows continuously through the second gas valve for cyclically increasing and decreasing the flame intensity at each of the burners. In the burner on/off cycle, the second valve is cyclically opened and closed whereby it is opened for a first time period and closed for a second time period during each cycle. During each cycle, the first gas valve is opened at the same time that the second gas valve is opened for allowing additional combustible gas to flow to the mixing device. At a delayed time following the beginning of the first time period and before the end of the first time period of each cycle, the first gas valve is closed and the flow of air through the air valve to the mixing device is reduced. At the end of the first time period of each cycle, the second gas valve is closed and the flow of air through the air valve is increased.

25 Claims, 3 Drawing Sheets

37
35
31
33
B1
B2
B3
B4
B5
B6
B7
B8
B9
R1
PO1
PO2
P
MV3
G
A
23
25
21
E
SP
19

CB
50
41
36
FSPC
R1
R2
RN

PO2
PO1

PO2
P
PI

PREMIX OVEN PULSING CONTROL SYSTEM

BACKGROUND OF THE INVENTION

1. Field of the Invention

The invention relates to a system for controlling gas burners.

2. Description of the Prior Art

There are a number of synthetics, such as thermoplastics, in sheet form that can be heated and conformed to a mold or tool with vacuum or pressure. The process of heating such synthetics requires selective controllability. Some require substantial amounts of BTU's and other reduced amounts. Therefore, the problem is versatility in order to achieve optimum heating for that particular synthetic. Electrical heaters have been employed in the past, however, their operating costs are too high and the results are not satisfactory. Gas burners also have been employed, however, the know prior art control systems for gas burners are not satisfactory.

SUMMARY OF THE INVENTION

It is an object of the invention to provide a new and useful system for controlling gas burners in both flame intensity and burner on/off cycle for the purpose of controlling micron infrared wave lengths and convection heat to synthetics, such as thermoplastics in sheet form. The invention allows the plastic time to absorb the BTU's created on its surface through its own specific heat conduction rate so as not to cause damage, but still decrease the heat time of that particular synthetic.

The system of the invention comprises a plurality of burners for burning a combustible gas mixture; a conduit extending to each of said burners for supplying a combustible gas mixture thereto; a source of air for providing air under pressure; a source of combustible gas; a mixing means coupled to the source of air, to the source of combustible gas, and to the conduit for mixing combustible gas and air for flow to the conduit; and air valve means coupled between the source of air and the mixing means for controlling the flow of air from the source of air to the mixing means. A control means is provided for cyclically increasing and decreasing the flow of air through the air valve means while combustible gas is allowed to continuously flow from the source of combustible gas to the mixing means for cyclically increasing and decreasing the flame intensity at each of the burners.

In a further aspect, first and second gas valve means are coupled between said source of combustible gas and said mixing means. Control means is provided for (a) cyclically opening and closing said second gas valve means whereby said second gas valve means is opened for a first time period and closed for a second time period during each cycle; (b) opening said first gas valve means at the same time that said second gas valve means is opened during each cycle for allowing additional combustible gas from said source of combustible gas to flow to said mixing means; (c) at a delayed time following the beginning of said first time period and before the end of said first time period of each cycle, closing said first gas valve means and reducing the flow of air through said air valve means to said mixing means; and (d) at the end of said first time period of each cycle, closing said second gas valve means and increasing the flow of air through said air valve means to said mixing means. This arrangement operates the burners in an on/off cycle.

In another aspect, there is provided a switching system for operating the burners in either a varying flame intensity cycle or an on/off cycle. This provides the desired versatility to achieve optimum heating for a particular synthetic. For example, plastic sheeting that has an optimum infrared range of 3 UM (microns) is best controlled with the burner on/off cycle. In another example, the thermoforming of composites require a higher temperature to form and shifting of the micron wave length to around 7 UM. This is best controlled by the flame intensity cycle high/low flame. The switching system allows the system to operate in either mode or state by a simple adjustment of the switch.

The burners of the invention comprise a plurality of burners located to form a row of burners. Means is coupled to each of said burners for varying the flow of combustible gas mixture to its burner. A pilot is located next to one of said burners intermediate the two ends of the row of burners. The pilot comprises a conduit having an inlet end for receiving a combustible gas mixture and two opposite facing outlet ends for directing two pilot flames in opposite directions. One outlet end faces one end of the row of burners, and the other outlet end faces the other end of the row of burners.

DESCRIPTION OF THE PREFERRED EMBODIMENT

Figure 1:
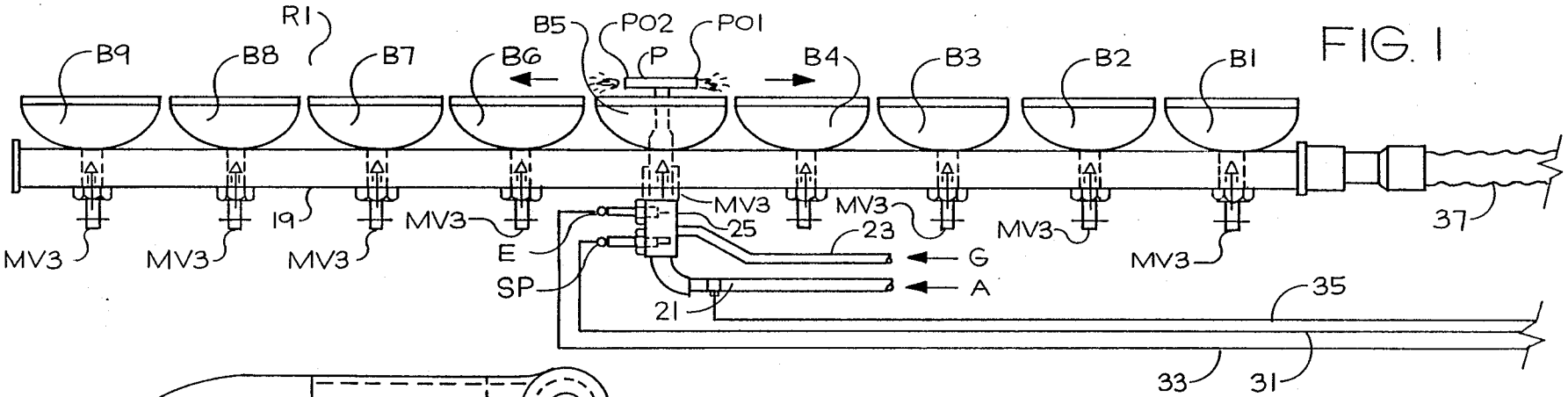
FIG. 1 is a side view of a row of burners.
Figure 7:
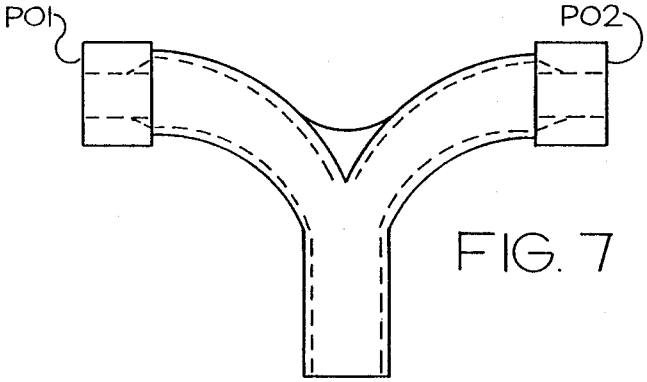
FIG. 7 is a drawing of the pilot with its forked nozzles.

Referring now to FIG. 1, there is disclosed a plurality of burners B1–B9 in a row R1 each of which is coupled to a conduit 19 for providing a combustible mixture of gas and air to the burners. Coupled to the conduit 19 are a plurality of manually adjustable gas valves MV3. One of each of the valves MV3 also is coupled to one of the burners B1–B9. Each valve MV3 has an orifice adjustment whereby it can be adjusted to vary the flow of gas to its burner and to shut off the flow of gas to its burner. An air line 21 and a gas line 23 are coupled to the inlet end P1 (see FIG. 8) of a pilot P located next to the burner B5. The pilot has two outlets PO1 and PO2 (see FIG. 7) which face in opposite directions with outlet PO1 facing burners B1–B4 and outlet PO2 facing burners B6–B9. A spark plug SP is coupled to a mixing device 25 for igniting the gas. The pilot P when ignited burns continuously. Member E is an electrode which acts as a flame safety sensor. Electrical leads 31 and 33 are connected to the spark plug SP and sensor E respectively for supplying electrical power thereto. Electrical lead 35 connected to metal air line 21 is a ground return lead.

Figure 2:
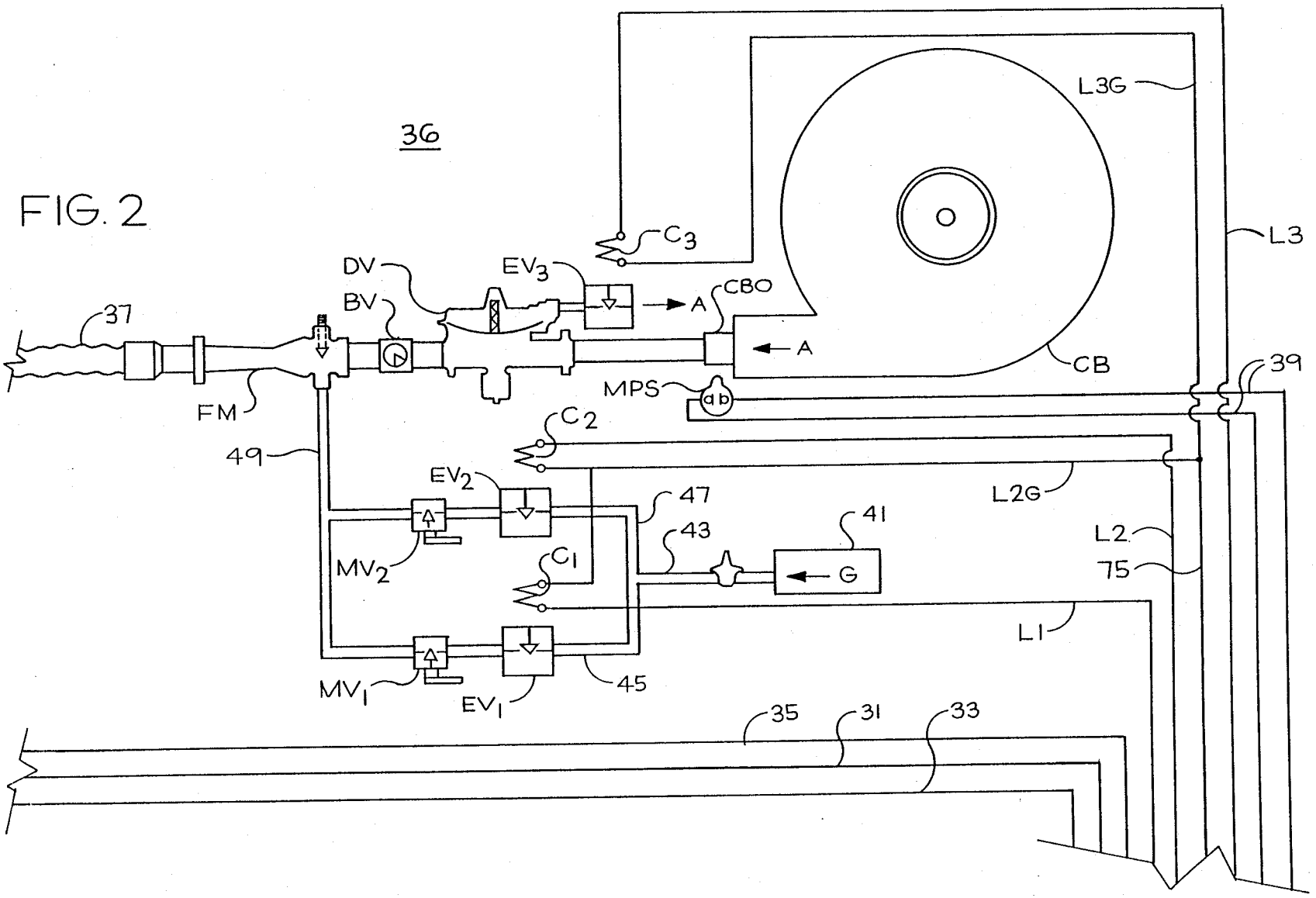
FIG. 2 illustrates a source of air and gas and a valving system.

Referring to FIG. 2 the valving system is identified by reference numeral 36. A flow air gas mixer FM is connected to the inlet end of the conduit 19 by way of conduit 37. A centrifugal air blower CB has its outlet CBO connected to the flow mixer FM by way of an air control diaphragm valve DV and an air control butterfly valve BV. The blower CB supplies the necessary volume of air and pressure to gas ratio for both burners and pilot. Air line 21 is connected to the outlet of the blower CB upstream of the valve DV (not shown). Member EV3 is a normally closed diaphragm control valve which opens when coil C3 is energized to exhaust air from the spring side of the diaphragm of the valve DV. When coil C3 is energized, the pressure and volume of air flowing through valve DV is less than when coil C3 is de-energized. Thus, valve DV automatically controls the rise and fall of air pressure and volume flowing to the mixer FM as coil C3 is energized and de-energized. The butterfly valve BV can be manually adjusted to reduce or increase the air flow and pressure desired.

Member MPS is a normally off mercury pressure switch which closes when the blower CB starts up. It is connected to a flame safety protection control system FSPC by way of electrical leads 39.

A source 41 of combustible gas, such as natural gas, is coupled to conduit 43 which is coupled to two conduits 45 and 47 which are coupled to conduit 49. Conduit 49 is coupled to mixer FM which is employed to mix the air and gas for flow to the burners. The source 41 also is coupled to the gas line 23 by an electrically controlled valve, not shown.

Main burner gas valve EV2 coupled to conduit 45, is a normally closed valve and comprises an electrical coil C2 which when energized opens valve EV2 to allow gas to flow to the mixer FM. A manual gas valve MV2 with orifice adjustment coupled to conduit 45 is provided for manual fine tune adjustment of the gas flowing through valve EV2 to the mixer FM.

Pulse gas valve EV1, coupled to conduit 43, is a normally closed valve and comprises an electrical coil C1 which when energized, opens valve EV1 to add a rich mixture of fuel for the relighting of the burners during the on/off cycle. A manual pulse gas valve MV1 with orifice adjustment coupled to conduit 43 is provided for manual fine tune adjustment of the gas flowing through valve EV1 to the mixer FM. During the flame intensity cycle, valve EV1 is closed and not used.

Figure 3:
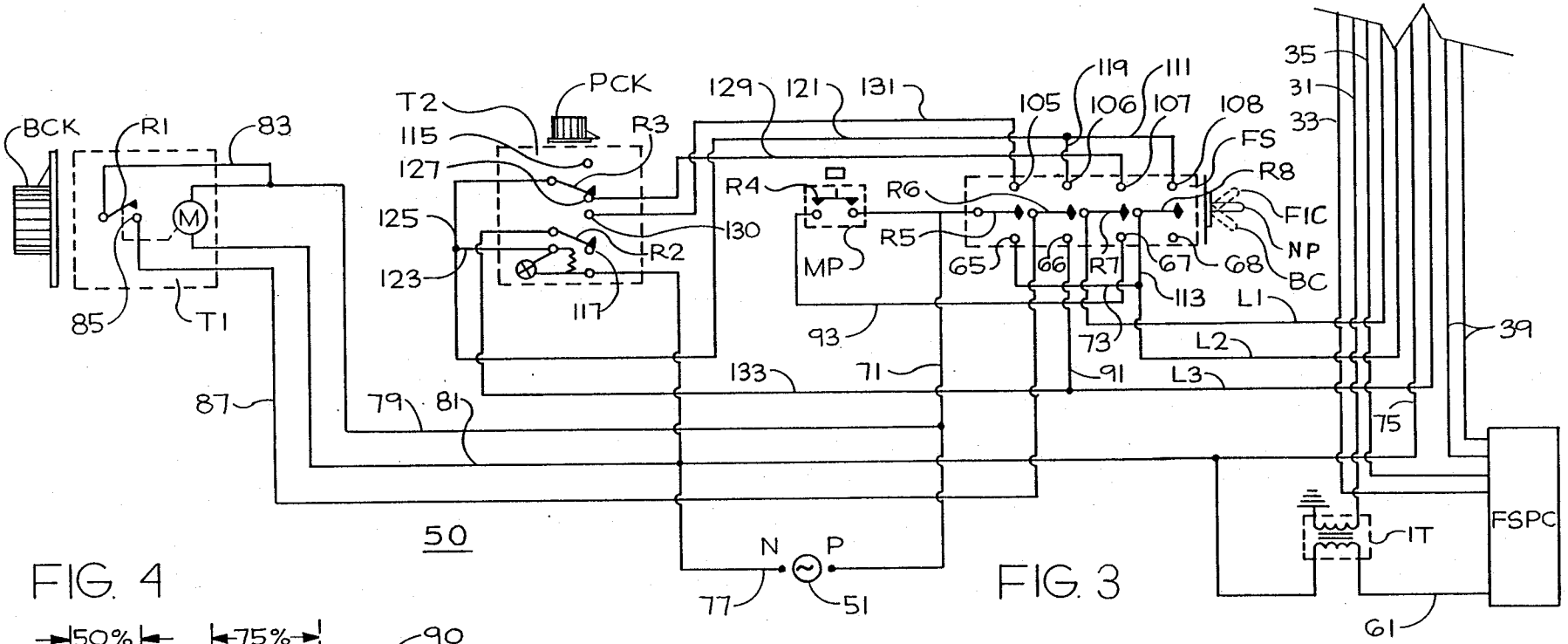
FIG. 3 is an electrical schematic of the electrical control system. The components of FIGS. 1–3 are mechanically and electrically connected together according to the reference numerals shown to form a complete system for controlling the burners of FIG. 1.

Referring to FIG. 3, the control system is identified by reference numeral 50. It is electrically coupled to a source 51 of AC power, to flame safety protection controls FSPC, and to coils C1, C2, and C3. The control system 50 comprises a percentage timer T1, a time delay relay T2, and a function switch FS. Switch FS is a three position, center off, 4 pole toggle switch which may be moved to a flame intensity cycle FIC position or a burner on/off cycle position BC to operate the burners in either mode. The time delay relay T2 is activated in the BC burner on/off cycle only. A manual pulse switch MP is activated manually in the flame intensity cycle in order to help the burners initially light during warm up.

There now will be described the flame intensity cycle wherein the flame intensity of the burners cyclically is increased and decreased. Initially, the operator starts up the centrifugal blower CB by closing an electrical switch (not shown). When the blower starts operating, the flame safety mercury pressure switch MPS closes and relays power to the flame safety protection control FSPC by way of leads 39. The FSPC applies power to an electrically controlled valve (not shown) to continuously release gas to the pilot P by way of line 23 to mix with the air which is present by way of line 21. At the same time, the FSPC relays power to an ignition transformer IT by way of lead 61 energizing a 6,000 volt DC current continuous charge to the spark plug SP by way of lead 31 until the fuel has ignited. Once ignited, a DC micro amp reading is sent back to the FSPC from the sensor E by way of lead 33 to signal flame on. Now with the FSPC locked in on the electrode flame safety sensor E, the flame intensity cycle FIC is selected on the function switch FS by moving the switch member NP in the up position. This causes contacts R5–R8 to move down to engage terminals 65–68. When contact R5 engages terminal 65, the positive side of the AC source 51 is connected to lead L2 by way of lead 71, contact R5, terminal 65, and lead 73. Lead L2 in turn is connected to the coil C2 whereby the coil C2 is energized to open valve EV2 to allow gas to flow to the mixer FM and hence to the burners. Lead L2G is a ground return lead which is connected to the negative side of the AC source 51 by way of lead 75 and lead 77.

The timer T1 has a lead 79 connected to the positive side of the AC source 51 and a lead 81 connected to the negative side of the AC source for applying electrical power to the timer. The timer T1 also includes a lead 83 connected to lead 79 and a switch R1 which cyclically engages and disengages a terminal 85 when the timer T1 is activated. Terminal 85 is connected to lead 87 which is in turn connected to contact R6 of the function switch FS. The timer T1 also includes a base control knob BCK which can be adjusted to vary the time period that the switch R1 engages the terminal 85 during each cycle. In this embodiment the total period of each cycle is 15 seconds. As one example, the cycle timer is set with the base control knob BCK at 50% of 15 seconds whereby the switch R1 engages the terminal 85 for 7.5 seconds and then disengages the terminal 85 for 7.5 seconds. The output of the timer T1 is illustrated at 90 in FIGS. 4 and 5.

When contact R6 of the function switch FS engages terminal 66, lead 87 is connected to lead L3 by way of contact R6, terminal 66, and lead 91. Lead L3 is connected to coil C3 which has a ground return lead L3G connected to ground return lead 75. Each time that contact R1 engages terminal 85, an electrical pulse or function having a time duration, in this embodiment, of 7.5 seconds is applied from the AC source 51, by way of the timer T1, to the coil C3 to energize the coil to open valve EV3 to decrease the air pressure and volume of the air flowing through the valve DV to the burners. The time that valve EV3 is open during a given cycle is illustrated at EV3 in FIG. 5. When contact R1 disengages terminal 85, coil C3 is de-energized, allowing valve EV3 to close which increases the air pressure and volume of the air flowing through the valve DV to the burners.

With the selection of the function switch FS to the FIC mode, the burners are already trying to light. Due to the cold nature of such a large sequential burner set up, it may be necessary to push the manual pulse momentary contact push button MP which closes normally open contact R4. When this occurs, the positive side of the AC source 51 is connected to lead L1 which is in turn connected to coil C1. Connection is by way of lead 71, contact R4, lead 93, terminal 67, and contact R7 of the function switch FS. This applies current to the coil C1 to energize the coil momentarily to open valve EV1 to apply a richer mixture of fuel to the burners enabling the sequential burners to light. If all of the burners do not light, then the user only has to repeat the pushing of the push button MP.

Figure 4:
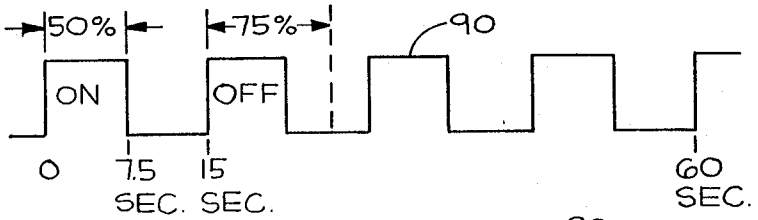
FIG. 4 is a diagram of the control timer on/off cycle.
Figure 5:
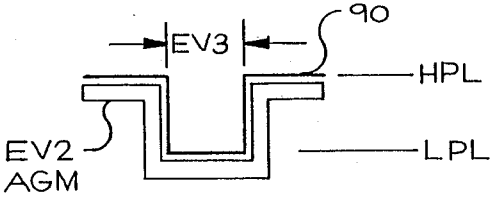
FIG. 5 is a diagram of a portion of the flame intensity cycle.

Now that the sequential burners are all ignited and burning, the cycle timer T1 has started driving the fuel mixture from a low pressure level LPL to a high pressure level HPL illustrated in FIG. 5 wherein AGM identifies the air gas mix. This increases the BTU density per square foot for the time on period. After the oven is cycling satisfactorily from high flame to low flame, the preset amount of time on can be reduced or increased, for example to 75%, to obtain the desired heat level, by adjusting the base control knob BCK of the cycle timer T1. The high/low flame repeats by the reenergizing of the coil C3 releasing air from the DV diaphragm valve through the valve EV3. When releasing air from the valve EV3, the flame intensity is in the low-flame state, which occurs during the off period of the cycle timer T1 as illustrated in FIG. 4. The gas valve EV2 stays on continuously during the FIC cycle.

The operation of the burner on/off cycle now will be described. It is desirable to operate the system in the flame intensity cycle FIC prior to the burner on/off cycle BC. This insures the lighting of the burners as well as a warm-up cycle to allow the burners ease of repeatability during the burner on/off cycle. Once the burners have been cycling in the flame intensity cycle for approximately 10 minutes, all the user has to do, to switch to the burner on/off cycle, is to actuate the function switch FS in the down position. The contacts R5–R8 in response to this action move up and engage terminals 105–108 respectively. This breaks existing control connections in the flame intensity cycle and remakes other connections in the burner on/off cycle. Now the user is in the burner on/off cycle. This is the selective controllability feature that offers the versatility for heating different synthetics.

In the burner on/off cycle lead 87 is electrically connected to lead L2 by way of contact R6, terminal 106, lead 111, terminal 108, contact R8, and lead 113. Thus, as contact R1 of timer T1 cyclically engages terminal 85, the coil C2 of the main gas burner valve EV2 is cyclically energized, cyclically allowing gas to flow from valve EV2 to the mixer FM and hence to the burners. Time delay relay T2 comprises two contacts R2 and R3 which normally engage terminals 115 and 117 respectively. The time delay of the relay T2 can be varied by adjustment of the pulse control knob PCK. When contact R6 engages terminal 106, lead 87 is connected to the time delay relay T2 and to contact R3 of T2 by way of lead 119, 121 and lead 123, 125 respectively. Thus, each time that contact R1 engages terminal 85, contact R3 simultaneously engages terminal 127 of the time delay relay T2 whereby the signal from lead 87 is applied to energize coil C1 which opens valve EV1. The connection from lead 87 to C1 is by way of contact R6, terminal 106, lead 119, lead 121, lead 125, contact R3, terminal 127, lead 129, terminal 107, contact R7, and lead L1. At this time, the circuit has power both to C1 of the pulse valve EV1 and to C2 of the gas valve EV2. The coil C3 of the diaphragm control valve EV3 does not have power which enables a high pressure level condition HPL. These three conditions in this state allow for the correct mixture for relighting repeatedly four time per minute.

Figure 6:
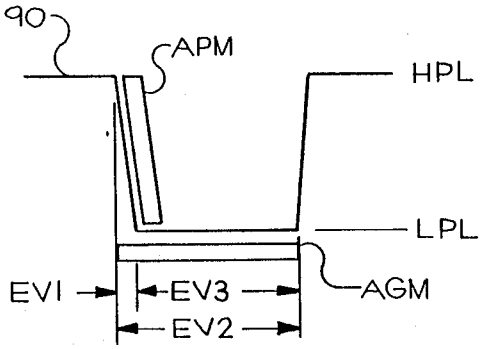
FIG. 6 is an enlarged diagram of a portion of the burner on/off cycle.

The time delay relay T2 is set for approximately 9/10 of one second after which the T2 timer times out disengaging contact R3 from terminal 127 and causing contact R3 to engage terminal 115. This removes electrical power from coil C1 of valve EV1 thereby causing valve EV1 to close. At the same time, timer T2 causes contact R2 to engage terminal 130. This connects the positive side of the source 51 to the coil C3 which opens valve EV3 and drives the diaphragm valve DV to low pressure level. Connection from the positive side of the source 51 to coil C3 is by way of lead 71, contact R5, terminal 105, lead 131, terminal 130, contact R2, lead 133, and lead L3. The coil C2 of valve EV2 remains energized to supply gas to the burners during the remaining portion of the time that contact R1 of timer T1 is closed. When contact R1 of timer T1 opens removing all electrical power beyond the contact R1, coil C2 is de-energized closing the main gas valve EV2 and the timer resets for the next cycle of input power from contact R1 of the timer T1. When the timer T2 resets, contact R2 disengages terminal 130 and engages terminal 117 removing power from coil C3 thereby closing valve EV3. This returns the valve DV to high pressure level. When the time off period of the cycle is over, the cycle repeats beginning with the time on period. FIG. 4 illustrates the power on and off from the timer T1. FIG. 6 illustrates the relative times that valves EV1, EV2, and EV3 are open during each cycle. In FIG. 6, AGM refers to the air gas mix from valve EV2, APM refers to the air pulse mix from valve EV1, LPL refers to the low pressure level, and HPL refers to the high pressure level.

Figure 9:
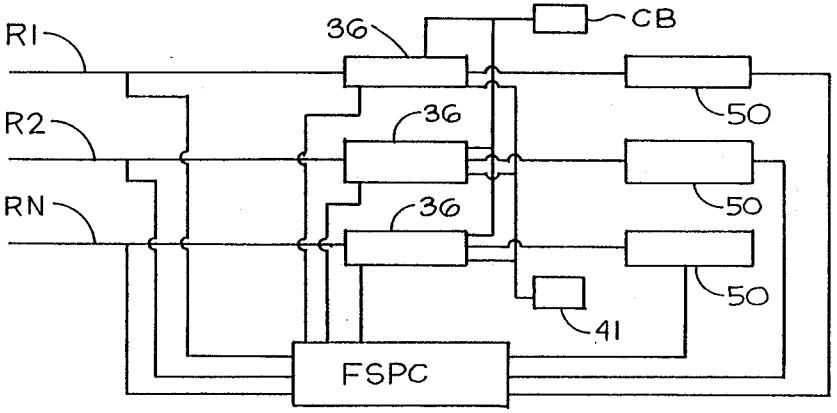
FIG. 9 is a schematic diagram of a plurality of side-by-side rows of the burners of FIG. 1 employed for heating a sheet of plastic.

For heating sheets of plastic material, a plurality of rows R1–RN of burners will be employed, as shown in FIG. 9, which each of the rows of burners being the same as the row R1. The number of burners of each row may be more or less than nine. Each of the rows of burners will have its own valving system 36 and its own control system 50 which may be adjusted independently of each other depending upon the circumstances and conditions. A single air blower CB, a single gas source 41, and a single safety protection control system FSPC will be employed and connected, as shown in FIG. 9. A plurality of stations, each having a plurality of rows of burners, can be employed and a sheet of plastic or synthetic transported sequentially to each station for proper heating prior to forming.

As can be understood, the invention has its advantages in that it has the ability to create two extremely different controlling systems with the actuation of one toggle switch and still fulfill the heating requirements for more than one kind of synthetic without any manual valve flow adjustments. As indicated above, the system can be operated in two modes which are the flame intensity cycle and the burner on/off cycle. In either mode, the timing cycle can be adjusted by adjusting the control knob BCK on the percentage timer T1. The flame intensity cycle is important in the lighting of the burner system. Due to the nature of the burner on/off cycle, it requires a warm-up period in order to immediately produce successful lighting from one burner to the other. The flame intensity cycle produces the necessary heat to get the reradiating qualities of the burner going. This eliminates the unnecessary waste of fuel.

The system for pulsing the burners can be tuned by adjusting the knob PCK of the time delay relay T2. This allows the ability to increase the distance of lighting across the burners. For example, less burners per row will reduce the time delay required and vise versa. Some manual adjustments may be made depending upon the length of the row of burners.

Figure 8:
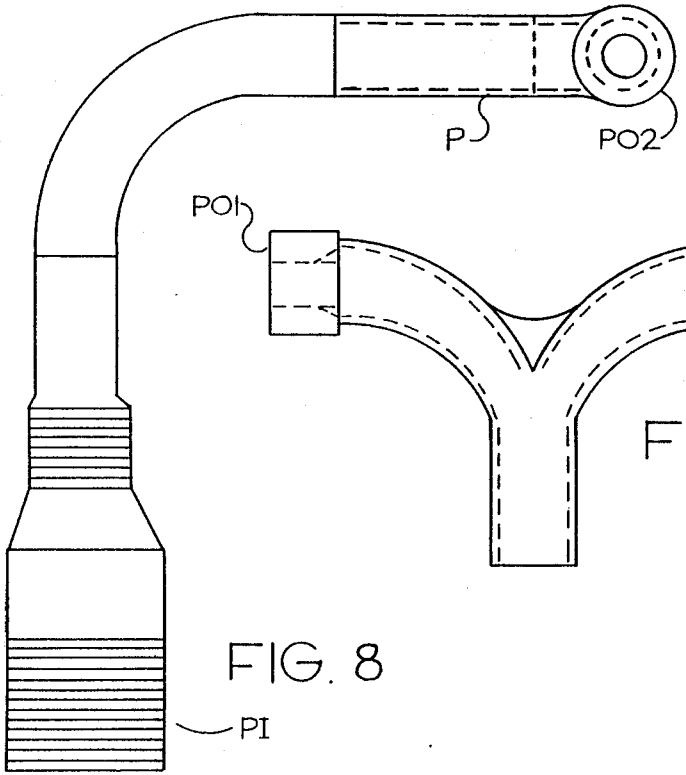
FIG. 8 is another view of the pilot showing its lower portion.

The location of the pilot in conjunction with its forked nozzle design is important in that the location of the pilot in the center of a row of burners allows for shorter lighting runs in either direction. The nozzle design separates the blast pilot flame forcing combustion down the burners on each side of the center. The hot gases and velocity from the outlets of the nozzle of the pilot help in the relighting process in the on/off cycle. Referring to FIGS. 1 and 8, the inlet end P1 of the pilot P is coupled to the mixing device 25 which is located to one side of the conduit 19. The pilot outlets PO1 and PO2 are located next to and above the burner B5.

The pilot remaining constantly on, not only establishes the flame safety protection system, but also reduces the amount of flame flare up during the pulsing at the time of relighting due to the distance of the row of burners on each side of the center of the row of burners.

In conjunction with the pilot, the control system pulsing mechanism decreases the response time for relighting the row of burners to approximately 9/10 of one second of the control cycle base time of 15 seconds, thus creating a wave of energy by extinguishing and relighting the row of burners 4 times per minute with the pulsing method. It has effectively decreased the heat time of plastic in the sheet thermal forming process and reduced the amount of energy consumption.

The system of the invention also saves on fuel consumption during the off period of the on/off cycle. This is due to the continuous heat radiating from the burners after the flame is extinguished. Convection heat is produced by the on going air pressure that exists moving the heat toward the plastic. This slowly cools the burners, but within 7 or 8 seconds (in the embodiment disclosed) the burners relight based upon 50% control.

As shown in FIG. 9, additional rows of burners can be added by duplicating the control device and valving set up for each row.

With a system of a plurality of rows of burners, target zoning can be applied to the heating process. In this respect the valves MV3 can be adjusted individually to control the amount of gas to the individual burners and hence the temperature of the burners. If less heating area is required, the outer burners can be shut off.

The system will still effectively work with the reduction of fuel at each of the individual burners. This is also a form of target zoning and during the burner on/off cycle, adjustments of the pulsing system time delay relay can be made in order for the running of the flame to continue from one burner to the other. The fuel supply to each burner, if reduced, will subsequently lower the impact of the flame to run. Thus, by increasing the time of the pulse on (EV1), the richer mixture has time to light at the low intensity burner.

During the burner on/off cycle, pulsing at the higher pressure applies more air and gas to flow the combustible mixture to the burners faster for quicker response time.

Valves MV1 and MV2 can be tuned to reduce flare up.

In one embodiment, the timer T1 is a percentage timer commercially available from Automatic Timing and Controls Inc. of King of Prussia, PA. Its control knob BCK can be adjusted to vary the time that contact R1 engages terminal 85 during each cycle. For example, the time on during each cycle may be 75% rather than 50% as illustrated in FIG. 4. It is to be understood that a timer may be employed for T1 which has a cycle period greater or less than 15 seconds. The time delay relay T2 is of the type commercially available from Syrelec Corporation of Dallas, Texas. The mercury pressure switch MPS, the flow mixer FM, the nozzle mixing device for the pilot P, the blower CB, the burners B, the diaphragm valve DV, and the valves EV1, EV2, EV3, are commercially available from the Eclipse Combustion Division of Eclipse Inc. of Rockford, Ill. The burner control devices MV3 and the valves MV1 and MV2 also are commercially available items. The flame safety protection control system FSPC is UL recognized and IRI approved and commercially available from Protection Controls Inc. of Skokie, Ill.

Although the particular arrangement of the invention has been illustrated and described here and above by way of example, it is not intended that the invention is to be limited thereto. Accordingly, the invention should be construded to include any and all modification, alterations, or equivilant arrangements falling within the scope of the annexed claims.

I claim:

1. A gas burner system, comprising:

a plurality of burners for burning a combustible gas mixture, conduit means extending to each of said burners for supplying a combustible gas mixture to each of said burners, a source of air coupled to said conduit means for providing air under pressure, a source of combustible gas coupled to said conduit means, air valve means coupled between said source of air and said conduit means for controlling the flow of air from said source of air to said conduit means, and control means for cyclically increasing and decreasing the flow of air through said air valve means while combustible gas is allowed to flow continuously from said source of combustible gas to said conduit means for cyclically increasing and decreasing the flame intensity at each of said burners, each cycle comprising first and second time periods wherein the flow of air through said air valve means is greater during one of said time periods than during the other of said time periods, said control means comprising means for varying said first and second time periods of each cycle.

2. The gas burner system of claim 1, wherein:

said control means comprises means for cyclically producing a control function for cyclically increasing and decreasing the flow of air through said air valve means and means for varying the period of said control function.

3. The gas burner system of claim 1, wherein:

said plurality of burners are located to form a row of burners, means coupled to each of said burners for varying the flow of combustible gas mixture to each of said burners, a pilot located next to said row of burners intermediate the two ends of the row of burners, said pilot comprising a conduit having an inlet end for receiving a combustible gas mixture and two opposite facing outlet ends for directing two pilot flames in opposite directions, one outlet end facing one end of said row of burners and the other outlet end facing the other end of said row of burners.

4. A gas burner system, comprising:

a plurality of burners for burning a combustible gas mixture, a conduit extending to each of said burners for supplying a combustible gas mixture to each of said burners, a source of air for providing air under pressure, a source of combustible gas, a mixing means coupled to said source of air, to said source of combustible gas, and to said conduit for mixing combustible gas and air for flow to said conduit, air valve means coupled between said source of air and said mixing means for controlling the flow of air from said source of air to said mixing means, gas valve means coupled between said source of combustible gas and said mixing means for controlling the flow of combustible gas from said source of combustible gas to said mixing means, and control means for controlling said gas valve means to allow combustible gas to flow continuously through said gas valve means and for cyclically increasing and decreasing the flow of air through said air valve means while combustible gas is allowed to flow continuously from said source of combustible gas to said mixing means for cyclically increasing and decreasing the flame intensity at each of said burners, each cycle comprising first and second time periods wherein the flow of air through said air valve means is greater during one of said time periods than during the other of said time periods, said control means comprising means for varying said first and second time periods of each cycle.

5. The gas burner system of claim 4, wherein:

said control means comprises means for cyclically producing a control function for cyclically increasing and decreasing the flow of air through said air valve means and means for varying the period of said control function.

6. The gas burner system of claim 4, wherein:

said plurality of burners are located to form a row of burners, means coupled to each of said burners for varying the flow of combustible gas mixture to its burner, a pilot located next to said row of burners intermediate the two ends of the row of burners, said pilot comprising a conduit having an inlet end for receiving a combustible gas mixture and two opposite facing outlet ends for directing two pilot flames in opposite directions, one outlet end facing one end of said row of burners and the other outlet end facing the other end of said row of burners.

7. A gas burner system, comprising:

a plurality of burners for burning a combustible gas mixture, conduit means extending to each of said burners for supplying a combustible gas mixture to each of said burners, a source of air coupled to said conduit means for providing air under pressure, a source of combustible gas coupled to said conduit means, air valve means coupled between said source of air and said conduit means for controlling the flow of air from said source of air to said conduit means, first gas valve means coupled between said source of combustible gas and said conduit means, second gas valve means coupled between said source of combustible gas and said conduit means, and control means for:

(a) cyclically opening and closing said second gas valve means whereby said second gas valve means is opened for a first time period and closed for a second time period during each cycle, said second gas valve means when opened allowing combustible gas from said source of combustible gas to flow to said conduit means, (b) opening said first gas valve means at the same time that said second gas valve means is opened during each cycle for allowing additional combustible gas from said source of combustible gas to flow to said conduit means, (c) at a delayed time following the beginning of said first time period and before the end of said first time period of each cycle, closing said first gas valve means and reducing the flow of air through said air valve means to said conduit means, (d) at the end of said first time period of each cycle, closing said second gas valve means and increasing the flow of air through said air valve means to said conduit means.

8. The gas burner system of claim 7, wherein:

said plurality of burners are located to form a row of burners, means coupled to each of said burners for varying the flow of combustible gas mixture to its burner, a pilot located next to said row of burners intermediate the two ends of the row of burners, said pilot comprising a conduit having an inlet end for receiving a combustible gas mixture and two opposite facing outlet ends for directing two pilot flames in opposite directions, one outlet end facing one end of said row of burners and the other outlet end facing the other end of said row of burners.

9. A gas burner system, comprising:

a plurality of burners for burning a combustible gas mixture, a conduit extending to each of said burners for supplying a combustible gas mixture to each of said burners, a source of air for providing air under pressure, a source of combustible gas, a mixing means coupled to said source of air, to said source of combustible gas, and to said conduit for mixing combustible gas and air for flow to said conduit, air valve means coupled between said source of air and said mixing means for controlling the flow of air from said source of air to said mixing means, first gas valve means coupled between said source of combustible gas and said mixing means, second gas valve means coupled between said source of combustible gas and said mixing means, and control means adapted to be operated in two different states, said control means when operated in said first state cyclically increases and decreases the flow of air through said air valve means while combustible gas is allowed to continuously flow from said source of combustible gas to said mixing means by way of said second gas valve means for cyclically increasing and decreasing the flame intensity at each of said burners, said control means when operated in the other of said states;

(a) cyclically opens and closes said second gas valve means whereby said second gas valve means is opened for a first time period and closed for a second time period during each cycle, said second gas valve means when opened allowing combustible gas from said source of combustible gas to flow to said mixing means, (b) opens said first gas valve means at the same time that said second gas valve means is opened during each cycle for allowing additional combustible gas from said source of combustible gas to flow to said mixing means, (c) at a delayed time following the beginning of each of said first time periods and before the end of each of said first time periods, closes said first gas valve means and reduces the flow of air through said air valve means to said mixing means, (d) at the end of said first time period of each cycle, closes said second gas valve means and increases the flow of air through said air valve means to said mixing means.

10. The gas burner system of claim 9, wherein:

said plurality of burners are located to form a row of burners, means coupled to each of said burners for varying the flow of combustible gas mixture to its burner, a pilot located next to said row of burners intermediate the two ends of the row of burners, said pilot comprising a conduit having an inlet end for receiving a combustible gas mixture and two opposite facing outlet ends for directing two pilot flames in opposite directions, one outlet end facing one end of said row of burners and the other outlet end facing the other end of said row of burners.

11. The gas burner system of claim 9, wherein:

each cycle of said control means when operated in said first state comprises first and second time periods wherein the flow of air through said air valve means is greater during one of said time periods than during the other of said time periods, said control means comprising means for varying said first and second time periods of each cycle of said control means when operated in either said first state or said second state.

12. A gas burner system comprising:

a plurality of burners for burning a combustible gas mixture, a conduit extending to each of said burners for supplying a combustible gas mixture to each of said burners, a source of air for providing air under pressure, a source of combustible gas, a mixing means coupled to said source of air, to said source of combustible gas, and to said conduit for mixing combustible gas and air for flow to said conduit, air valve means coupled between said source of air and said mixing means for controlling the flow of air from said source of air to said mixing means, first gas valve means coupled between said source of combustible gas and said mixing means, second gas valve means coupled between said source of combustible gas and said mixing means, switch means operable in two different states, a first circuit coupled between said switch means and said first gas valve means, a second circuit coupled between said switch means and said second gas valve means, a third circuit coupled between said switch means and said air valve means, a timer circuit for cyclically producing a timing function having a time duration less than each cycle, said timer circuit being connected to said switch means, time delay circuit connected to said switch means, in said first state of said switch means, electrical power is connected to said second circuit for controlling said second gas valve means to allow combustible gas to flow continuously through said second gas valve means and said timer circuit is connected to said third circuit for controlling said air valve means for cyclically increasing and decreasing the flow of air through said air valve means while combustible gas is allowed to flow continuously from said source of combustible gas to said mixing means for cyclically increasing and decreasing the flame intensity at each of said burners, in said second state:

(a) said timer circuit is connected to said second circuit for cyclically opening and closing said second gas valve means whereby said second gas valve means is opened for a first time period and closed for a second time period during each cycle, said second gas valve means when opened allows combustible gas from said source of combustible gas to flow to said mixing means by way of said second gas valve means, said second gas valve means when closed prevents the flow of combustible gas from said source of combustible gas to said mixing means by way of said second gas valve means, (b) at the same time that said second gas valve means is opened during each cycle, said time delay circuit connects said timer circuit to said first circuit to open said first gas valve means for allowing additional combustible gas from said source of combustible gas to flow to said mixing means, (c) at a delayed time following the beginning of said first time period and before the end of said first time period of each cycle, said time delay circuit interrupts the connection of said timer circuit to said first circuit to close said first gas valve means and connects electrical power to said third circuit for decreasing the flow of air through said air valve means to said mixing means, electrical power normally is not connected to said third circuit whereby said air valve means normally is fully open, (d) at the end of said first time period of each cycle said time delay circuit disconnects electrical power from said third circuit for increasing the flow of air through said air valve means to said mixing means.

13. The gas burner system of claim 12, wherein:

said plurality of burners are located to form a row of burners, means coupled to each of said burners for varying the flow of combustible gas mixture to its burner, a pilot located next to said row of burners intermediate the two ends of the row of burners, said pilot comprising a conduit having an inlet end for receiving a combustible gas mixture and two opposite facing outlet ends for directing two pilot flames in opposite directions, one outlet end facing one end of said row of burners and the other outlet end facing the other end of said row of burners.

14. The gas burner of claim 12, wherein:

each cycle of said control means when operated in -- said first state comprises first and second time per- of combustible gas to flow to said associated conduit means, (b) opening its associated first gas valve means at the same time that its associated second gas valve means is opened during each cycle for allowing additional combustible gas from said source of combustible gas to flow to its associated conduit means, (c) at a delayed time following the beginning of said first time period and before the end of said first time period of each cycle, closing its associated first gas valve means and reducing the flow of air through its associated air valve means to its associated conduit means, (d) at the end of said first time period of each cycle, closing its associated second gas valve means and increasing the flow of air through its associated air valve means to its associated conduit means.

15. A gas burner system for heating a work piece, comprising:

a plurality of rows of burners, each of said rows of burners comprising a plurality of burners for burning a combustible gas mixture, said plurality of rows of burners being located such that a work piece may be moved near and away from said plurality of rows of burners, a separate conduit means for each of said rows of burners, for supplying a combustible gas mixture to each of said rows of burners, a source of air coupled to each of said conduit means for providing air under pressure, a source of combustible gas coupled to each of said conduit means, a separate air valve means coupled between each of said conduit means and said source of air for controlling the flow of air from said source of air to each of said conduit means, and a separate control means for each of said rows of burners for cyclically increasing and decreasing the flow of air through each of said air valve means while combustible gas is allowed to flow continuously from said source of combustible gas to each of said conduit means for cyclically increasing and decreasing the flame intensity at each of said burners of each of said rows of burners, each of said control means being separately controllable.

16. The gas burner system of claim 15, wherein:

the cycle of each of said control means comprises first and second time periods wherein the flow of air through each of said air valve means is greater during one of said time periods than during the other of said time periods, each of said control means comprising means for varying said first and second time periods of each cycle of each of said control means.

17. A gas burner system, comprising:

a plurality of rows of burners, each of said rows of burners comprising a plurality of burners for burning a combustible gas mixture, said plurality of rows of burners being located such that a work piece may be moved near and away from said plurality of rows of burners, a separate conduit means for each of said rows of burners for applying a combustible gas mixture to each of said rows of burners, a source of air coupled to each of said conduit means for providing air under pressure, a source of combustible gas coupled to each of said conduit means, a separate mixing means coupled between each of said conduit means and said source of air and said source of combustible gas for mixing combustible gas and air for flow to each of said conduit means, a separate air valve means coupled between each of said mixing means and said source of air for controlling the flow of air from said source of air to each of said mixing means, a separate gas valve means coupled between each of said mixing means and said source of combustible gas for controlling the flow of combustible gas from said source of combustible gas to each of said mixing means, and a separate control means for each of said rows of burners for cyclically increasing and decreasing the flow of air through each of said air valve means respectively while combustible gas is allowed to flow continuously from said source of combustible gas to each of said conduit means respectively for cyclically increasing and decreasing the flame intensity at each of said burners of each of said rows of burners respectively, each of said control means being separately controllable.

18. The gas burner system of claim 17, wherein:

the cycle of each of said control means comprises first and second time periods wherein the flow of air through each of said air valve means respectively is greater during one of said time periods than during the other of said time periods, each of said control means comprising means for varying said first and second time periods of each cycle of each of said control means.

19. A gas burner system, comprising:

a plurality of burners for burning a combustible gas mixture, conduit means extending to each of said burners for supplying a combustible gas mixture to each of said burners, a source of air coupled to said conduit means for providing air under pressure, a source of combustible gas coupled to said conduit means, air valve means coupled between said source of air and said conduit means for controlling the flow of air from said source of air to said conduit means, first gas valve means coupled between said source of combustible gas and said conduit means, second gas valve means coupled between said source of combustible gas and said conduit means, and control means for:

(a) cyclically opening and closing said second gas valve means whereby said second gas valve means is opened for a first time period and closed for a second time period during each cycle, said second gas valve means when opened allowing combustible gas from said source of combustible gas to flow to said conduit means, (b) opening said first gas valve means at the same time that said second gas valve means is opened during each cycle for allowing additional combustible gas from said source of combustible gas to flow to said conduit means, (c) at a delayed time following the beginning of said first time period and before the end of said first time period of each cycle, closing said first gas valve means and reducing the flow of air through said air valve means to said conduit means, (d) at the end of said first time period of each cycle, closing said second gas valve means and increasing the flow of air through said air valve means to said conduit means, said control means comprising means for varying said first and second time periods of each cycle.

20. A gas burner system, comprising:

a plurality of rows of burners, each of said rows of burners comprising a plurality of burners for burning a combustible gas mixture, said plurality of rows of burners being located such that a work piece may be moved near and away from said plurality of rows of burners, a separate conduit means for each of said rows of burners for supplying a combustible gas mixture to each of said rows of burners, a source of air coupled to each of said conduit means for providing air under pressure, a source of combustible gas coupled to each of said conduit means, a separate air valve means coupled between each of said conduit means and said source of air for controlling the flow of air from said source of air to each of said conduit means, a separate first gas valve means coupled between each of said conduit means and said source of combustible gas, a separate second gas valve means coupled between each of said conduit means and said source of combustible gas, and a separate control means for each of said conduit means and hence for each of said rows of burners for operating said first and second gas valve means and said air valve means associated with each of said conduit means, by:

(a) cyclically opening and closing its associated second gas valve means whereby its associated second gas valve means is opened for a first time period and closed for a second time period during each cycle, said associated second gas valve means when opened allowing combustible gas from said source of combustible gas to flow to said associated conduit means, (b) opening its associated first gas valve means at the same time that its associated second gas valve means is opened during each cycle for allowing additional combustible gas from said source of combustible gas to flow to its associated conduit means, (c) at a delayed time following the beginning of said first time period and before the end of said first time period of each cycle, closing its associated first gas valve means and reducing the flow of air through its associated air valve means to its associated conduit means, (d) at the end of said first time period of each cycle, closing its associated second gas valve means and increasing the flow of air through its associated air valve means to its associated conduit means.

21. The gas burner system of claim 20, wherein:

each of said control means comprises means for varying said first and second time periods of each cycle of each of said control means.

22. A gas burner system, comprising:

a plurality of rows of burners, each of said rows of burners comprising a plurality of burners for burning a combustible gas mixture, said plurality of rows of burners being located such that a work piece may be moved near and away from said plurality of rows of burners, a separate conduit extending to each of said rows of burners for supplying a combustible gas mixture to each of said rows of burners, a source of air for providing air under pressure, a source of combustible gas, a separate mixing means coupled to each of said conduits and to said source of air and to said source of combustible gas for mixing combustible gas and air for flow to each of said conduit, a separate air valve means coupled between each of said mixing means and said source of air for controlling the flow of air from said source of air to each of said mixing means, first gas valve means coupled between each of said mixing means and said source of combustible gas, second gas valve means coupled between each of said mixing means and said source of combustible gas, and a separate control means for each of said conduits and hence for each of said rows of burners for operating said first and second gas valve means and said air valve means associated with each of said conduits, each of said control means being adapted to be operated in two different states, each of said control means when operated in said first state cyclically increases and decreases the flow of air through its associated air valve means while combustible gas is allowed to continuously flow from said source of combustible gas to its associated mixing means by way of its associated second gas valve means for cyclically increasing and decreasing the flame intensity at each of said burners of its associated row of burners, each of said control means when operated in the other of said states:

(a) cyclically opens and closes its associated second gas valve means whereby its associated second gas valve means is opened for a first time period and closed for a second time period during each cycle, said associated second gas valve means when opened allowing combustible gas from said source of combustible gas to flow to said associated mixing means, (b) opens its associated first gas valve means at the same time that its associated second gas valve means is opened during each cycle for allowing additional combustible gas from said source of combustible gas to flow to its associated mixing means, (c) at a delayed time following the beginning of each of said first time periods and before the end of each of said first time periods, closes its associated first gas valve means and reduces the flow of air through its associated air valve means to its associated mixing means, (d) at the end of said first time period of each cycle, closes its associated second gas valve means and increases the flow of air through its associated air valve means to its associated mixing means.

23. The gas burner system of claim 22, wherein:

each cycle of each of said control means when operated in its first state comprises first and second time periods wherein the flow of air through its associated air valve means is greater during one of said time periods than during the other of said time periods, each of said control means comprising means for varying said first and second time periods of each cycle of each of said control means when operated in either said first state or said second state.

24. A gas burner system comprising:

a plurality of rows of burners, each of said rows of burners comprising a plurality of burners for burning a combustible gas mixture, said plurality of rows of burners being located such that a workpiece may be moved near and away from said plurality of rows of burners, a separate conduit extending to each of said rows of burners for supplying a combustible gas mixture to each of said rows of burners, a source of air for providing air under pressure, a source of combustible gas, a separate mixing means coupled to each of said conduits and to said source of air and to said source of combustible gas for mixing combustible gas and air for flow to each of said conduit, a separate air valve means coupled between each of said mixing means and said source of air for controlling the flow of air from said source of air to each of said mixing means, first gas valve means coupled between each of said mixing means and said source of combustible gas, second gas valve means coupled between each of said mixing means and said source of combustible gas, a separate control means for each of said conduits and hence for each of said rows of burners for operating said first and second gas valve means and said air valve means associated with each of said conduits, each of said control means comprising:

switch means operable in two different states, a first circuit coupled between said switch means and said first gas valve means associated with said control means, a second circuit coupled between said switch means and said second gas valve means associated with said control means, a third circuit coupled between said switch means and said air valve means associated with said control means, a timer circuit for cyclically producing a timing function having a time duration less than each cycle, said timer circuit being connected to said switch means, time delay circuit connected to said switch means, in said first state of said switch means, electrical power is connected to said second circuit for controlling said second gas valve means associated with said control means to allow combustible gas to flow continuously through said second gas valve means associated with said control means and said timer circuit is connected to said third circuit for controlling said air valve means associated with said control means for cyclically increasing and decreasing the flow of air through said air valve means associated with said control means while combustible gas is allowed to flow continuously from said source of combustible gas to said mixing means coupled to said conduit associated with said control means for cyclically increasing and decreasing the flame intensity at each of said burners of said row of burners associated with said control means, in said second state:

(a) said timer circuit is connected to said second circuit for cyclically opening and closing said second gas valve means associated with said control means whereby said second gas valve means associated with said control means is opened for a first time period and closed for a second time period during each cycle, said second gas valve means associated with said control means when opened allows combustible gas from said source of combustible gas to flow to said mixing means coupled to said conduit associated with said control means, said second gas valve means associated with said control means when closed prevents the flow of combustible gas from said source of combustible gas to said mixing means coupled to said conduit associated with said control means, (b) at the same time that said second gas valve means associated with said control means is opened during each cycle, said time delay circuit connects said timer circuit to said first circuit to open said first gas valve means associated with said control means for allowing additional combustible gas from said source of combustible gas to flow to said mixing means coupled to said conduit associated with said control means, (c) at a delayed time following the beginning of said first time period and before the end of said first time period of each cycle, said time delay circuit interrupts the connection of said timer circuit to said first circuit to close said first gas valve means associated with said control means and connects electrical power to said third circuit for decreasing the flow of air through said air valve means, associated with said control means, to said mixing means coupled to said conduit associated with said control means, electrical power normally is not connected to said third circuit whereby said air valve means associated with said control means normally is fully open, (d) at the end of said first time period of each cycle said time delay circuit disconnects electrical power from said third circuit for increasing the flow of air through said air valve means, associated with said control means, to said mixing means coupled to said conduit associated with said control means.

25. The gas burner system of claim 24, wherein:

each cycle of each said control means when operated in its first state comprises first and second time periods wherein the flow of air through its associated air valve means is greater during one of said time periods than during the other of said time periods, each of said control means comprising means for varying said first and second time periods of each cycle of each of said control means when operated in either said first state or said second state.

* * * * *